United States Patent [19]

Dragomir

[11] 4,295,228

[45] Oct. 20, 1981

[54] BOXING GLOVES WITHOUT A SEAM ON THE FRONTAL STRIKE PORTION THEREOF

[76] Inventor: Stojičić Dragomir, Jurija Gagarina 211/9, 11070 Novi Beograd, Yugoslavia

[21] Appl. No.: 107,973

[22] Filed: Dec. 28, 1979

[30] Foreign Application Priority Data

Jan. 17, 1979 [YU] Yugoslavia ..... 18/79

[51] Int. Cl.[3] ..... A41D 13/10

[52] U.S. Cl. ..... 2/18

[58] Field of Search ..... 2/18, 161 A

[56] References Cited

U.S. PATENT DOCUMENTS

| | | | |
|---|---|---|---|
| 1,401,722 | 12/1921 | Oldham | 2/18 |
| 2,416,444 | 2/1947 | Hilton | 2/18 |
| 2,446,758 | 8/1948 | Golomb | 2/18 |
| 2,556,759 | 6/1951 | Hilton | 2/18 |
| 3,540,059 | 11/1970 | Kennedy | 2/18 |

*Primary Examiner*—Louis Rimrodt

*Attorney, Agent, or Firm*—Peter J. Georges

[57] ABSTRACT

A boxing glove is disclosed herein which is made of a unitary piece of leather on the frontal portion of the same so as to eliminate the seam which normally transcends the inner bottom of the thumb portion and the striking surface of the glove. The glove may be made of Nappa leather and contains all the seams present therein in the interior portion of the palm.

3 Claims, 3 Drawing Figures

FIG. 1
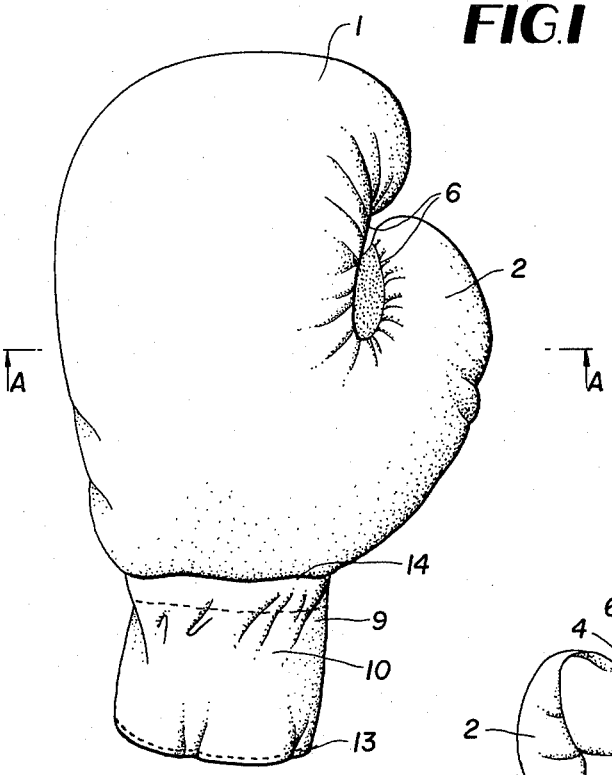
FIG. 2
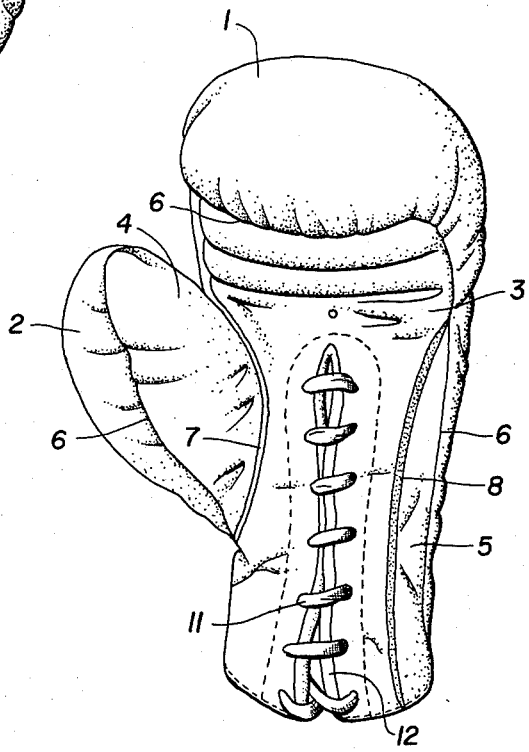
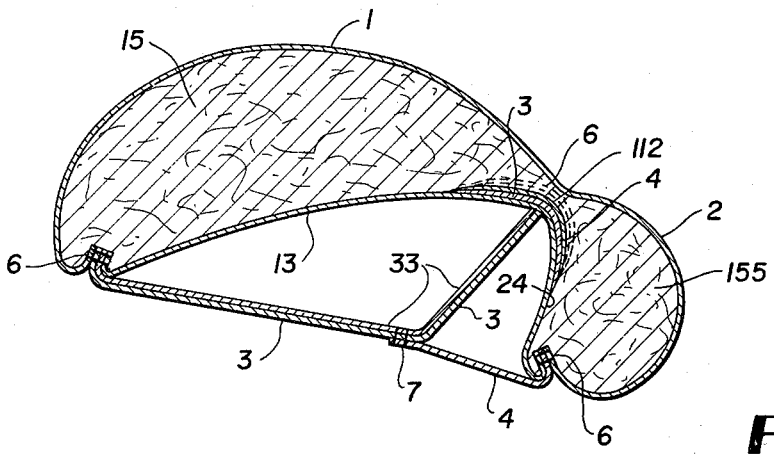
FIG. 3

BOXING GLOVES WITHOUT A SEAM ON THE FRONTAL STRIKE PORTION THEREOF

BACKGROUND OF THE INVENTION

This invention relates to a boxing glove which does not possess a seam upon the front or strike portion of the glove used for striking an opponent.

This invention also relates to a method of securing a boxing glove to maintain the same as a unitary entity during heavy use in a pugilistic match.

In the sport of boxing cuts or abrasions to the face of a fighter, particularly around the eyes, can be critical to the determination of the winner of a boxing match. In such instances, it is quite likely that a boxer possessing more finesse and greater boxing skills than his opponent will have to withdraw from combat as a result of the loss or impairment of proper vision as a result of these cuts and abrasions. The same can occur as a result of the leather striking the skin and tearing the same, or until now, they may have occurred from the scraping of the seams of the strike portion of the glove across the face of a fighter. This invention is directed to a boxing glove and a process for manufacturing the same which will not possess such a frontal strike area seam.

The method of manufacturing this boxing glove will also reduce a number of hours required to prepare the same and modify the type of leather cut heretofore normally utilized for such pugilistic instruments.

PRIOR ART

The following design patents disclose various types of gloves: d 235,821 (D2-361); d 240,571 (D2-361); d 246,077 (D2-06); and d 249,400 (D2-06). The latter two design patents illustrate an embodiment wherein a hand is held in a unitary segment of hard plastic or flexible cloth. Moreover, these design patents do not address the problems of facial cuts caused by a poorly situated seam or even the same type of cushioned striking instrument for use in a boxing match.

The following utility patents have been uncovered in regard to this invention and are believed somewhat relevant to the instant appended claims: U.S. Pat. No. 2,416,444 (2-18); U.S. Pat. No. 2,446,758 (2-18); and U.S. Pat. No. 3,540,059 (2-18). The oldest of these disclosures (1947) shows an improved thumb system to prevent opponents from being gouged either intentionally or accidentally. This system includes a padded thumb section with an overextending pad to limit the gouging ability of the thumb when the fist of the boxer is in either open or clenched manner. The portion of the glove covering the top part of the hand, normally referred to as the striking portion, is connected to the padded thumb section by a seam which traversed both the top and bottom parts of the glove. The U.S. Pat. No. 2,446,758 discloses a boxing glove which repositions the seam of the thumb from across the ball of the thumb to a seam which encircles the perimeter of the thumb and is attached to a second portion of the glove via a seam extending to the frontal strike portion of the glove. The outer portion of the padded thumb is joined to the front portion of the glove by a conventional seam, which will inevitably contact an opponents face during a boxing contest. As previously stated, it is desirable to avoid such situations. The last aforementioned U.S. Pat. No. 3,540,059, is concerned with the same problem as the first discussed utility U.S. Pat. No. 2,416,444, i.e. gouging injuries which result from the position of the thumb.

In order to eliminate this problem this patent discloses a boxing glove wherein the thumb is confined against movement away from the mitt part of the glove by attaching the same under the ply of the finger portion of the gloves.

Thus, this boxing glove differs from those of the prior art in that the instant glove provides a high quality convenient product within the traditional requirements of boxing gloves that can be formulated from a special cut of leather. This special cut of leather is sewn together so that any frontal seam is recessed to prevent any external seams on the strike portion of the glove. The sewing of this glove also allows that leather wrinkles, which are normally indigenous to the striking surface, are arranged and drawn into hidden places not on the striking surface and advantageously anchored within the interior or backside of the glove.

SUMMARY OF THE INVENTION

Succintly stated, this invention resides in a boxing glove which does not possess a seam to attach the thumb section of the same to the strike portion of the glove. These gloves can be made in any desired weight from six, eight, or twelve ounces for competition and fourteen to sixteen ounces for training purposes. The gloves may be made of any material but are preferably made from leather or canvas and most preferably from Nappa leather and will be supplied with a spongy and/or hairy filling within the glove. The Nappa leather is chosen because of its properties of elasticity, quality and technical characteristics.

The seams of the boxing glove are repositioned so as not to form a seam on the strike portion of the glove. Therefore, the seams of the inner or back of the glove are placed more to the center of the palm than in the traditional or conventional boxing gloves as depicted in the aforementioned prior art patents. The instant glove is designed to comply with all regulations of amateur boxing such as the International Boxing Association and is believed to qualify for use in the 22nd Olympia to be held in Moscow in 1980. The gloves are further described in the appended drawings 1 through 3 and the description of the same, however the gloves described therein may possess any type of lacing or securing means as known in the conventional type of boxing gloves.

DESCRIPTION OF THE DRAWINGS

FIG. 1 is a frontal view of the strike portion of the glove;

FIG. 2 is the back portion of the boxing glove showing the applicable attachment seams;

FIG. 3 is a view cut along the portion of FIG. 1 marked A and showing the cross section view of the boxing glove.

DETAILED DESCRIPTION OF THE DRAWINGS

In FIG. 1 the frontal portion of a boxing glove is disclosed having a surface 1 for striking an opponent. The term frontal portion is herein defined as the portion of glove situated next to the back of the hand. In the alternative, the back portion of the glove coincides with the section enclosing the palm of the boxer's hand. The frontal surface possesses a unitary construction without the existence of any seams to cut or tear an opponent. The thumb surface 2, encircling the thumb, is attached to striking surface 1 without resort to a seam in the back of the glove. Thus, the exterior surfaces 1 and 2 support a complete whole planar surface or piece of leather without a seam being disposed therein.

The very end of the glove proximate to the boxer's wrist is sealed by means of elastic strips 13 and 14. The interior of the glove is filled with a spongy material or swine hair 15 and 155 (see FIG. 3) in sections 1, 2 and 10 to cushion a boxer's blow to an opponent. In FIG. 2, surfaces 1 and 2 are shown in their normal position bent towards palm surfaces 3 and 5 plus thumb surface 4. External surfaces 3, 4 and 5 are interconnected with external frontal portions 1 and 2 by a continuous seam 6, which encircles back surfaces 3, 4 and 5 and extends to glove's opening for insertion of the boxer's hand. Surfaces 3 and 5 are connected by seam 8 while surfaces 3 and 4 are connected by seam 7. The bottom part of the glove contains pocket 10 formed by seams 13 and 14 and contains the same or similar spongy material as beneath surface 1. The thumb surface 2 bends toward the thumb root so that in the first position, while the hand is in the glove, part of the seam only runs between interior surface 4 and exterior surfaces 1 and 2 and thereby eliminates an external seam on the striking surface. The glove possesses a string 11 and eyelets for securing the glove to the hands of the user.

In FIG. 3 the frontal portion of the glove is shown as exterior strike portion 1 and exterior thumb portion 2. These respective entities are made from a unitary piece of leather and contain stuffing 15 and 155. The spongy material is present in open interconnection as a result of the aforementioned lack of a seam bifurcating the thumb and frontal strike portions of the glove. In order to maintain the glove as a unitary entity without wrinkles appearing on the frontal strike portion, the glove is secured by layers of material which are tucked and attached at advantageously appropriate places. For instance, material layers 33, 34 and 24 are aligned to form a seam at 112. At this junction a triple napped ply is formed which provides a proper fold and conjunctly reinforcement of the palm section of the glove. The aforementioned material depicted as 33, 3, 4, 7 and 24 is a fabric such as a pile fabric, which will provide support for the portion of glove containing the tucked pile fabric. As shown in FIG. 3, pile fabric 3 and 33 plus 4 and 24 are inwardly tucked at 6 on both sides of the palm of the glove. This inwardly tucked double pile fabric at 6 provides a more compactly held exterior leather and thus eliminates not only the aforementioned outer seam but also the wrinkles indigenous to all leather inserts stretched in such a fashion. The connection of pile fabric 24 and 3 at tucked area 6 allows the glove to possess a unitary interconnected stuffed area. In other words, stuffing 15 and 155 are comprised of fungible materials and may freely migrate from the thumb area to the frontal strike area.

We claim as our invention:

1. A boxing glove comprising a frontal strike portion, a palm portion and a thumb portion, wherein said frontal strike portion and thumb portion represent a unitary piece and are slanted inwardly in a convex manner towards said palm portion and wherein said frontal portion and said thumb portion are mutually joined in said palm portion by fabric seams inwardly tucked at the point where (1) the interior of said thumb section interconnects with said palm portion; (2) said frontal strike portion at the opposite extreme from said thumb side interconnects with said palm portion and (3) said convexly situated frontal strike portion interconnects with the top portion of said palm portion, said interconnections comprising the attachment of at least two separate ply fabrics and wherein said attachment provides an open interconnection of stuffing between the interiors of said frontal strike portion and said thumb portion.

2. The boxing glove of claim 1 further characterized in that the same is made from Nappa leather.

3. The boxing glove of claim 1 further characterized in that the exterior portion of the striking area of the glove are a unitary piece of Nappa leather.

* * * * *